US006407503B1

(12) United States Patent
Mizobata

(10) Patent No.: US 6,407,503 B1
(45) Date of Patent: Jun. 18, 2002

(54) PLASMA DISPLAY PANEL

(75) Inventor: Eishi Mizobata, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/395,258

(22) Filed: Sep. 13, 1999

(30) Foreign Application Priority Data

Sep. 14, 1998 (JP) ..... 10-260326

(51) Int. Cl.[7] ..... H01J 17/49
(52) U.S. Cl. ..... 313/587; 313/492
(58) Field of Search ..... 313/585, 586, 313/587, 491, 492, 633, 634, 493

(56) References Cited

U.S. PATENT DOCUMENTS 5,907,311 A * 5/1999 Yano ..... 313/585
6,211,614 B1 * 4/2001 Katayama et al. ..... 313/582
6,295,040 B1 * 9/2001 Nhan et al. ..... 345/60

FOREIGN PATENT DOCUMENTS

JP 5-101782 4/1993 ..... H01J/11/00
JP 5-242811 9/1993 ..... H01J/11/00
JP 8-7770 1/1996 ..... H01J/11/00
JP 8-96716 4/1996 ..... H01J/11/00
JP 8-96717 4/1996 ..... H01J/11/00
JP 9-115450 5/1997 ..... H01J/11/00
JP 9-265913 10/1997 ..... H01J/11/02

OTHER PUBLICATIONS

Japanese Office Action, dated Aug. 1, 2000, with partial English translation.

* cited by examiner

*Primary Examiner*—Michael H. Day
(74) *Attorney, Agent, or Firm*—McGinn & Gibb, PLLC

(57) ABSTRACT

A three-electrode AC type plasma display panel has an array of display cells each including therein pair of scanning electrode and common electrode extending in perpendicular to a data electrode. The capacitance of the insulating film disposed between the scanning electrode and the data electrode is higher than the capacitance of the insulating film disposed between the common electrode and the data electrode, whereby stable discharge can be obtained between the scanning electrode and the data electrode while suppressing discharge between the common electrode and the data electrode. The difference in the capacitance is obtained by a configuration of a dielectric film, fluorescent film or the data electrode.

13 Claims, 6 Drawing Sheets

PLASMA DISPLAY PANEL

FIELD OF THE INVENTION

The present invention relates to a plasma display panel (PDP) and, more particularly, to a PDP of a three-electrode AC discharge type which is capable of operating in a stable state.

DESCRIPTION OF A RELATED ART

In general, a PDP has a large number of advantages of smaller thickness, lower flicker, larger contrast, larger display area, quicker response etc., and thus is expected for use as a flat panel display unit in a personal computer system or a workstation system as well as a wall television.

PDPs are categorized by the operational principle thereof into two types: a DC discharge type wherein bare electrodes are exposed to a discharge space (or discharge gas) for operation at a DC driving voltage; and an AC discharge type wherein electrodes are insulated from the discharge gas by an insulating coat for operation at an AC driving voltage. The DC discharge type is such that the discharge in the display cell continues during the period wherein the DC driving voltage is applied, whereas the AC discharge type is such that the polarities of the driving voltage are switched for maintaining the discharge. The AC discharge type PDP referred to as AC-PDP hereinafter is categorized into two types: a two-electrode type and a three-electrode type.

The structure and driving method of a conventional three-electrode AC-PDP will be described with reference to FIG. 1 showing a display cell of the conventional PDP in cross-section.

The AC-PDP includes a front substrate 11 and a rear substrate 12 opposed to each other, a plurality of electrodes disposed on the substrates 11 and 12, an array of display cells disposed at intersections of the electrodes. The electrodes includes a plurality of scanning electrodes 13 and a plurality of common electrodes 14 extending in parallel to one another, and a plurality of data electrodes 21 extending in parallel to one another and in perpendicular to the scanning electrodes 13 and the common electrodes 14.

The front substrate 11 is made of a glass plate mounting thereon the scanning electrodes 13 and the common electrodes 14 at a specified pitch. A dielectric film 15 and a protective film 16 for protecting the dielectric film 15 against the electric discharge are consecutively formed on the scanning electrodes 13 and the common electrodes 14. The rear substrate 12 is also made of a glass plate mounting thereon the data electrodes 21, on which a white dielectric film 10 and a fluorescent film 19 are consecutively formed. A plurality of ribs 17 are formed for defining a plurality of display cells and maintaining a specified gap between the glass substrates 11 and 12.

Each display cell defined by the ribs 17 functions as a discharge space, which is filled with a discharge gas including He, Ne and Xe, for example. The structure of the PDP is described, for example, in a literature "Society for Information Display '98 Digest" pp279–281, May 1998.

FIG. 2 shows a schematic top plan view of a general three-electrode AC-PDP, wherein a plurality of scanning electrodes S1, S2, . . . and a plurality of common electrodes C1, C2, . . . extend in a row direction, one of the scanning electrodes and one of he common electrodes forming an electrode pair, whereas a plurality data electrodes D1, D2, . . . extend in the column direction. A display cell or pixel 23 is formed at each intersection between the electrode pair and the data electrodes, a plurality of display cells 23 forming an array.

A separate driving scheme is generally used in current driving techniques for driving the AC-PDP, wherein a scanning period and a sustaining discharge period are separately provided. FIG. 3 shows a timing chart of driving signals used in the separate driving technique.

In FIG. 3, a first erasing pulse 31 is applied to each scanning electrode S1, S2, . . . for erasing the previous sustaining discharge in each cell, thereby effecting an initialization of all the cells. Subsequently, a preliminary discharge pulse 32 is applied to each common electrode C1, C2, . . . for conducting a preliminary discharge in each cell. The preliminary discharge functions for allowing a write discharge in each cell to start at a lower voltage.

Thereafter, a second erasing pulse 33 for erasing the preliminary discharge is applied to each scanning electrode S1, S2, . . . to control the wall charge in each cell generated on the dielectric film by the preliminary discharge. The period from the first erasing pulse to the second erasing pulse is called herein an erasing period. In the above description, although a single pulse is applied to electrodes at each of the first erasing voltage, preliminary discharge voltage and the second erasing voltage, a pulse train including a plurality of pulses may be applied in each driving voltages for achieving an even discharge in the cell area and suppressing the fluctuation of the electric load. Each driving pulse or pulse train may be applied to other electrodes other than those described above.

Subsequently, a scanning period is conducted by supplying a scanning pulse 34 consecutively to the scanning electrodes S1 to Sn for consecutive selection of the scanning electrodes S1 to Sn. In synchrony with supplying the scanning pulse 34, data pulses 35 are supplied to the data electrodes D1 to Dn depending on the display data. In each selected data electrode, to which a data pulse is supplied, a high voltage is applied for conducting a discharge between the scanning electrode 13 and the data electrode 21 to write the cell with the display data. Thus, each of the selected cells has larger positive wall charge generated by the high voltage near the scanning electrode 13 and negative wall charge generated by the high voltage near the data electrode 21. On the other hand, in each non-selected data electrode 21, to which a data pulse is not supplied, a discharge is not generated without changing the wall charge in the cell. In these procedures, a display data is stored in the display cells depending on the presence or absence of the data pulse.

After the scanning pulse 34 is supplied to all the scanning electrodes S1 to Sn, the PDP shifts into a sustaining discharge period wherein a sustaining pulse train is supplied to each electrode pair, whereby the scanning electrode and the common electrode are alternately supplied with sustaining pulses. The voltage of the pulse train is selected such that the pulse train cannot start a discharge by itself in each display cell without the wall charge generated by the write operation.

In the display cell having the larger positive wall charge, the first sustaining pulse of the pulse train having a negative polarity and supplied to the common electrode 14 applies the display cell with a voltage higher than the break-down voltage, thereby starting a sustaining discharge in association with the positive wall charge in the cell. The sustaining discharge by the first sustaining pulse stores negative wall charge near the scanning electrode 13 and positive wall charge near the common electrode 14.

A second sustaining pulse of the pulse train supplied to the scanning electrode 13 generates another sustaining discharge in association with the wall charge as generated by the first sustaining pulse, whereby wall charge having inverse polarities is stored near the scanning electrode 13 and the common electrode 14. Thereafter, similar sustaining discharges are generated by the alternate sustaining pulses. In this sustaining discharge period, the wall charge generated by the previous sustaining pulse is used for generating the next sustaining discharge in association with the next sustaining pulse. The number of sustaining discharges effected in a display cell determines the luminance or brightness of the display cell.

A combination of the erasing period, scanning period and sustaining discharge period as described above defines a sub-field of the PDP. In a gray-scale display scheme, a field for displaying one-screen image data includes a plurality of sub-fields, each sub-field generating a sustaining pulse train including an inherent number of sustaining pulses. The gray-scale display is effected by selecting an active state or an inactive state for each cell during each sub-field.

The conventional three-electrode AC-PDP as described above involves a problem in that the allowable range of the voltage for the scanning pulse 34 in the scanning period by which the PDP operates in a normal state is narrow depending on the load capacitance of the cell. Thus, the write discharge may be started in the cell which is not supplied with the data pulse, or cannot be started in the cell which is supplied with the data pulse. In addition, the sustaining discharge may be started irrespective of the presence or absence of the write discharge.

SUMMARY OF THE INVENTION

In view of the above problem involved in the conventional three-electrode AC-PDP, it is an object of the present invention to provide an improved three-electrode AC-PDP which is capable of operating in a stable state without malfunction.

The present invention provides a three-electrode AC-PDP including first and second substrates opposed to each other, a plurality of scanning electrodes and a plurality of common electrodes extending in parallel to one another on the first substrate, a first insulator film covering the scanning electrode and the common electrode, a plurality of data electrodes extending in parallel to one another and substantially in perpendicular to the scanning electrodes and the common electrodes, a second insulator film covering the common electrode, the first substrate and the second substrate defining therebetween a plurality of display cells having a discharge space, each of the display cells including a first cell portion where the data electrode opposes the scanning electrode and a second cell portion where the data electrode opposes the common electrode, at least one of the first insulator film and the second insulator film having a first capacitance per unit area in the first cell portion and a second capacitance per unit area in the second cell portion, the second capacitance per unit area being smaller than the first capacitance per unit area.

The smaller capacitance (electrostatic capacity) of the insulator film disposed in the second cell portion between the common electrode and the data electrode suppresses a discharge in the discharge space between the common electrode and the data electrode. In addition, if an undesirable discharge occurs between the common electrode and the data electrode, the sustaining discharge is suppressed because of smaller wall charge generated by the undesirable discharge due to the smaller capacitance generating a smaller electric field in the discharge space cell between the common electrode and the data electrode.

More specifically, the capacitance between the common electrode and the data electrode is defined as a serial branch of the capacitance of the first insulator film, the capacitance of the discharge space and the capacitance of the second insulator film. If the second insulator film (or first insulator film) has a smaller capacitance in the second cell portion than in the first cell portion, the discharge space in the second cell portion is subjected to a lower discharge voltage than in the first cell portion, whereby the discharge space in the second cell portion is less subjected to electric discharge. In a typical AC-PDP, the second insulator film includes a dielectric film and a fluorescent film formed on the data electrode.

The above and other objects, features and advantages of the present invention will be more apparent from the following description, referring to the accompanying drawings.

PREFERRED EMBODIMENTS OF THE INVENTION

Figure 1:
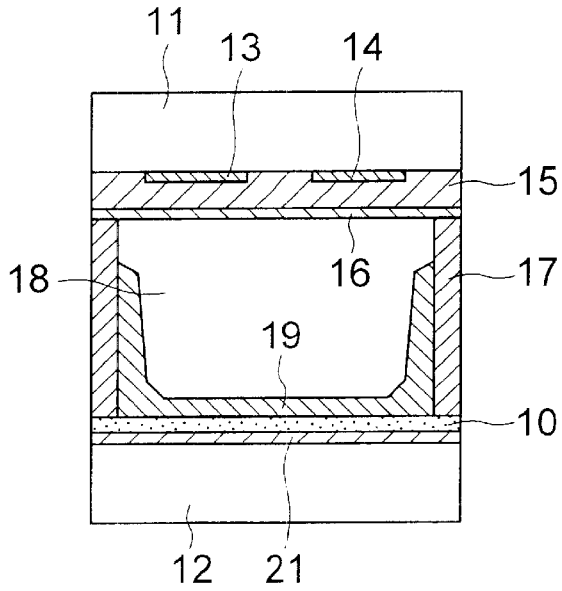
FIG. 1 PRIOR ART
FIG. 1 is a cross-sectional view of a display cell in a conventional three-electrode AC-PDP.

Now, the present invention is more specifically described with reference to accompanying drawings, wherein similar constituent elements are designated by similar reference numerals throughout the drawings.

Figure 2:
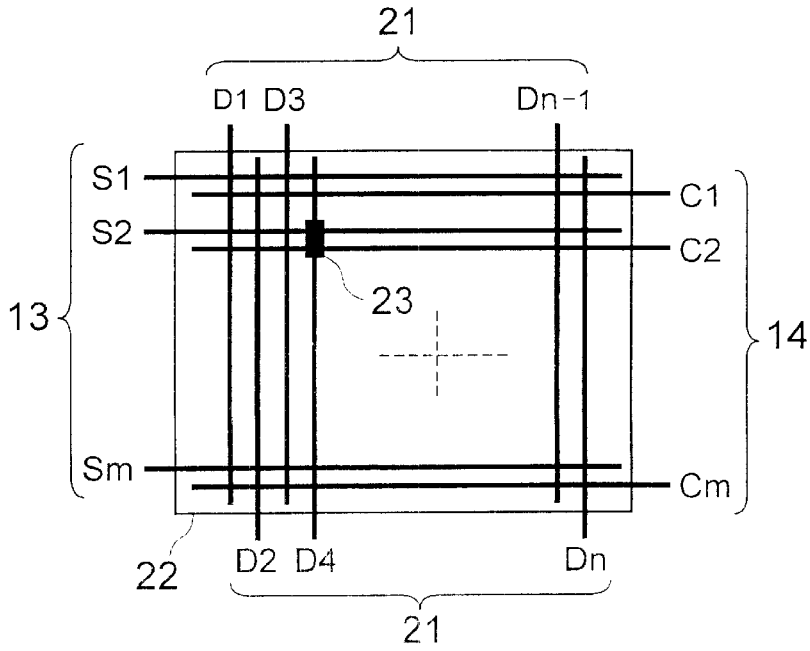
FIG. 2 PRIOR ART
FIG. 2 is a top plan view of the AC-PDP of FIG. 1.
Figure 3:
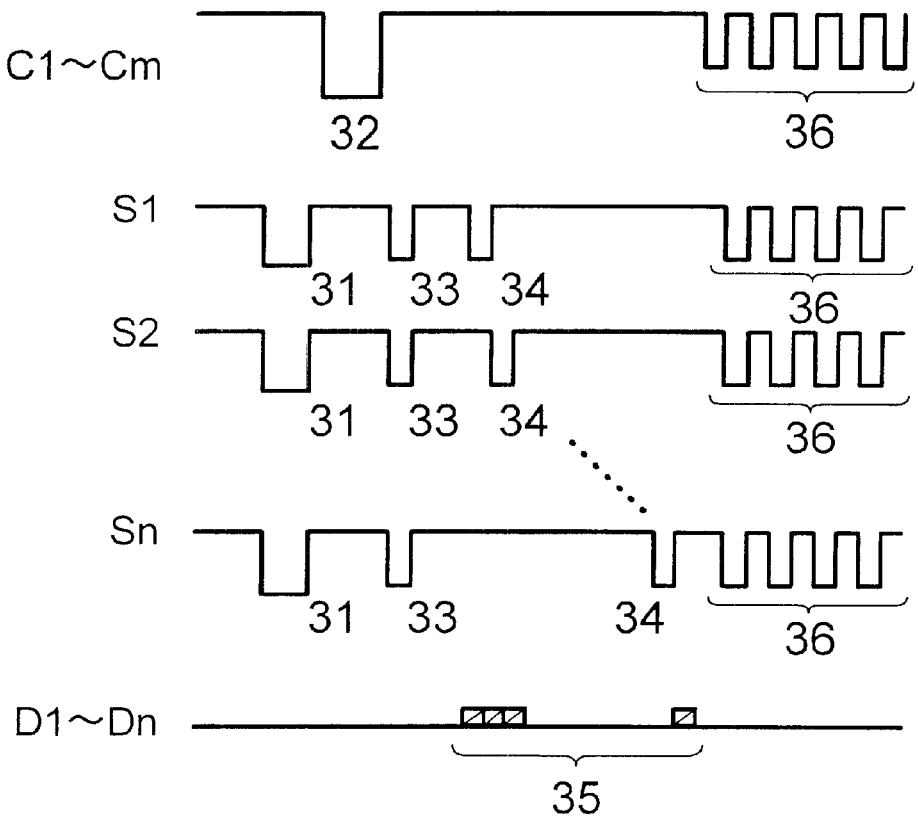
FIG. 3 is a timing chart of driving signals in the AC-PDP of FIG. 1.
Figure 4:
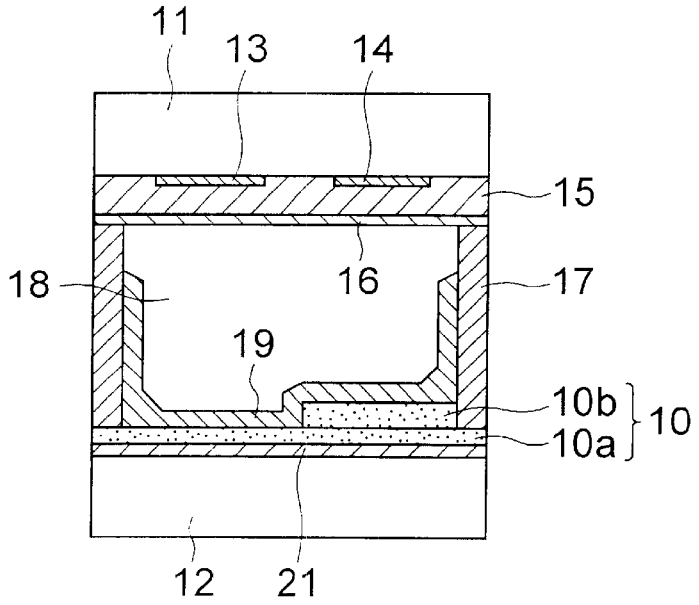
FIG. 4 is a cross-sectional view of a display cell in an AC-PDP according to a first embodiment of the present invention.

Referring to FIG. 4, a three-electric AC-PDP according to a first embodiment of the present invention includes a front substrate 11 and a rear substrate 12 opposed to each other, a plurality of electrodes disposed on the front and rear substrates 11 and 12, an array of display cells disposed at intersections of the electrodes. The electrodes includes a plurality of scanning electrodes 13 and a plurality of common electrodes 14 extending in parallel to one another, and a plurality of data electrodes 21 extending in parallel to one another and in perpendicular to the scanning electrodes 13 and the common electrodes 14. The arrangement of the electrodes and the display cells is similar to that described with reference to FIG. 2.

The front substrate 11 mounts thereon the scanning electrodes 13 and the common electrodes 14 at a specified pitch. A transparent dielectric film 15 and a transparent protective film 16 for protecting the transparent dielectric film 15 against the electrical discharge in the discharge space are consecutively formed on the scanning electrodes 13 and the common electrodes 14. A plurality of ribs 17 are formed for defining a plurality of display cells and maintaining a specified gap between the glass substrates 11 and 12.

In the display cell, the capacitance of the insulator film between the common electrode 14 and the data electrode 21 is made smaller than the capacitance thereof between the scanning electrode 13 and the data electrode 21. This is achieved by the insulator film including the white dielectric film 10 and the fluorescent film 19 formed on the data electrode 21, which defines a capacitance-per-unit-area distribution of the insulator film.

The front and the rear substrates 11 and 12 are made of sodalime glass plate having a thickness of 2 to 5 mm, for example. The scanning electrode 13 and the common electrode 14 formed as a transparent electrode pair on the front substrate 11 include tin oxide or indium oxide as the main ingredient thereof and have a thickness of 100 to 500 nm. For a pitch of 1 mm of the display cells, the width of the scanning electrode 13 and the common electrode 14 is 200 to 300 nm and the gap between the scanning electrode 13 and the common electrode 14 is 50 to 200 $\mu$m. Each electrode 13 or 14 may have a trace electrode made of Ag having a thickness of 2 to 7 $\mu$m for reducing the resistance of the electrode 13 or 14.

The transparent dielectric film 15 is made of glass paste including a PbO—$Ba_2O_3$—$SiO_2$ based material and having a dielectric constant of about 10 to 25 and a thickness of 10 to 50 $\mu$m. The transparent dielectric film 15 is formed by baking at a temperature of about 500 to 600° C. The protective film 16 is made of evaporated MgO having a thickness of 0.5 to 2$\mu$m.

The rear substrate 12 mounts thereon the data electrodes 21 made of Ag having a thickness of 2 to 4 $\mu$m. A white dielectric film 10 covering the data electrode 21 has a large thickness portion opposing the common electrode 14 in a second area of the display cell, and a small thickness portion opposing the scanning electrode 13 in a first area of the display cell, thereby achieving the in-plane capacitance-per-unit-area distribution of the insulator film. The white dielectric film 10 is made of white glass paste wherein a PbO—$B_2O_3$—$SiO_3$ based glass material having a low melting point and a dielectric constant of 10 to 25 is mixed with $TiO_2$ at a ratio of 10:1.

The white dielectric film 10 is formed on the rear substrate 12 by a first step for forming a first layer 10*a* of the white dielectric film 10 having a thickness of 5 to 40 $\mu$m and subsequent baking at a temperature of 500 to 600° C., and a second step for forming a second layer 10*b* of the white dielectric film 10 having a thickness of 5 to 40 $\mu$m by printing and subsequent baking at a temperature of 500 to 600° C. in the second area of the display cell.

After the white. dielectric film 10 is formed, ribs 17, which separate the display cells and maintain the gap between the substrates 11 and 12, are formed by a patterning technique using sand blasting. Subsequently, a fluorescent film 19 is formed by spreading to a thickness of 10 to 15 $\mu$m. At this step, different fluorescent materials for red, green and blue colors are used for the fluorescent film 19 in each display cell for effecting a full color display. The fluorescent materials include (Y, Gd)$BO_3$:Eu for red, $Zn_2SiO_4$:Mn for green and $BaMgAl_{10}O_{17}$:Eu for blue.

After the front substrate 11 and the rear substrate 12 are bonded together with a gap therebetween and baked at a temperature of 350 to 500° C., each display cell is exhausted and then filled with 200 to 600 Torr of discharge gas including a mixture of He, Ne and Xe.

Figure 5:
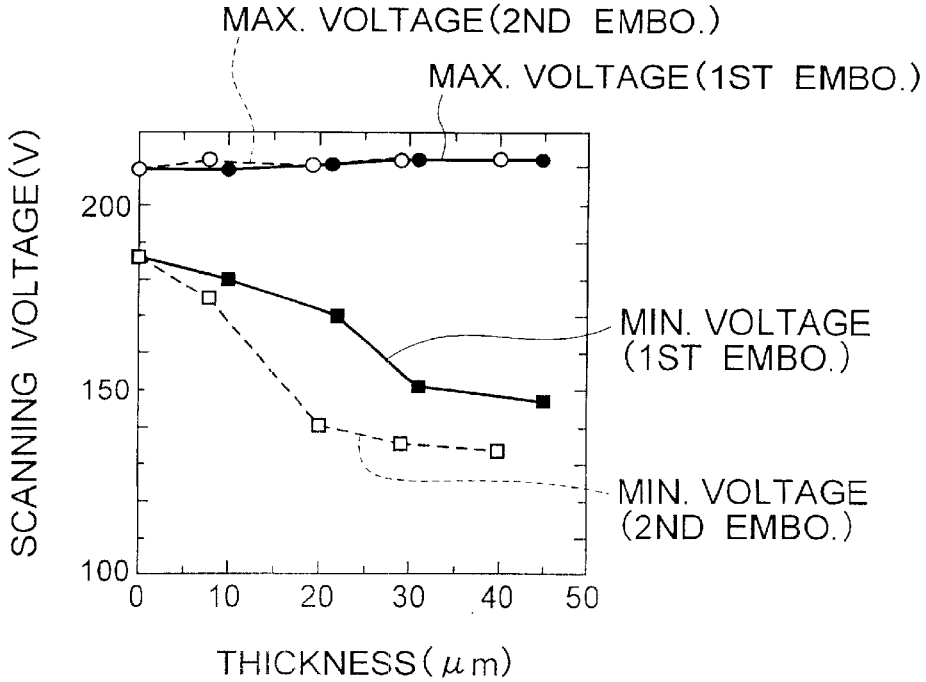
FIG. 5 is a graph for showing the dependency of the maximum and the minimum voltages of the scanning pulse with respect to the thickness of the white dielectric film in the first embodiment as well as the second embodiment.

Referring to FIG. 5, there are shown actual measurements of the maximum and minimum voltages of the scanning pulse plotted against different thicknesses of the second layer 10*b* of the dielectric film 10 in the first embodiment, the scanning pulse having a voltage between the maximum voltage and the minimum voltage allowing a normal operation of the PDP. In FIG. 5, the minimum voltage of the scanning pulse monotonically decreases with the increase of the thickness of the second layer 10*b*, with the maximum voltage remaining substantially at a constant, whereby the voltage range of the scanning pulse for a normal operation of the PDP monotonically increases with the increase of the thickness of the second layer 10*b*.

In the AC-PDP of the first embodiment, the capacitance between the common electrode 14 and the data electrode 21 is represented by a serial branch of the capacitance of the dielectric film 15 on the common electrode 14, the capacitance of the discharge space and the capacitance of the combination of the white dielectric film 10 and the fluorescent film 19 on the scanning electrode 21.

In the operation of the AC-PDP, the discharge between the scanning electrode 13 and the data electrode 21 as well as the discharge between the scanning electrode 13 and the common electrode 14 is used for image. display, whereas a discharge between the common electrode 14 and the data electrode 21 is unnecessary and may be a cause of a malfunction. Thus, in the present embodiment, the capacitance of the white dielectric film 10 disposed between the common electrode 14 and the data electrode 21 is made smaller compared to the capacitance of the first layer 10*a* of the white dielectric film 10 disposed between the scanning electrode 13 and the data electrode 21, thereby effectively generating a discharge in the cell while suppressing the undesirable discharge. In a more generalized expression, the capacitance per unit area of the insulator film disposed between the scanning electrode and the data electrode in the first area of the display cell is larger than the capacitance per unit area of the insulator film disposed between the common electrode and the data electrode in the second area of the display cell. The larger capacitance per unit area assures a stable discharge in the discharge space, whereas the smaller capacitance per unit area prevents a discharge in the discharge space, whereby the PDP of the present embodiment operates in a more stable state.

Figure 6:
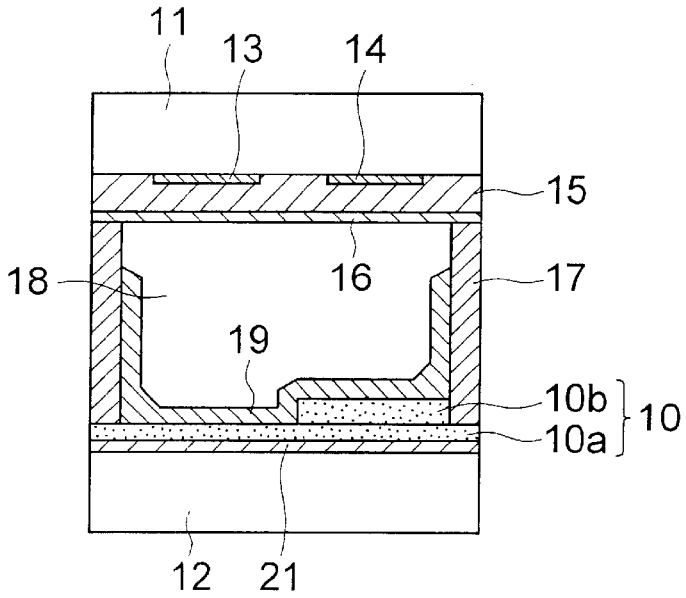
FIG. 6 is a cross-sectional view of a display cell in an AC-PDP according to a second embodiment of the present invention.

Referring to FIG. 6, an AC-PDP according to a second embodiment of the present invention is similar to the first embodiment except that the second layer 10*b* of the white dielectric film 10 is made of a PbO—$Ba_2O_3$—$SiO_2$ based or ZnO based glass paste having a dielectric constant of about 8.5 which is lower than the dielectric constant of the first layer 10*a* of the white dielectric film 10.

In FIG. 5 as mentioned above, the minimum voltage of the scanning pulse for a normal operation of the PDP of the present embodiment monotonically decreases with the increase of the thickness of the second layer 10*b* of the white dielectric film 10, with the maximum voltage of the scanning pulse being substantially at constant. The decrease of the minimum voltage of the scanning pulse is more remarkable than the first embodiment, which shows the advantage of the second embodiment over the first embodiment.

Figure 7:
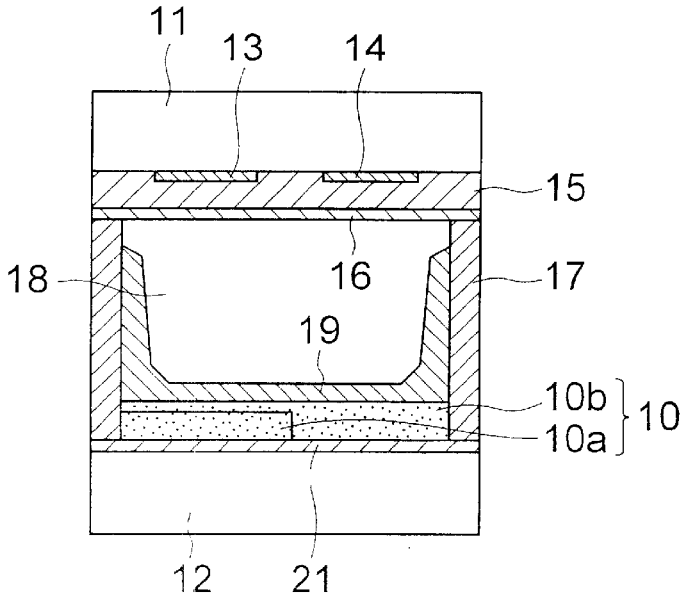
FIG. 7 is a cross-sectional view of a display cell in an AC-PDP according to a third embodiment of the present invention.

Referring to FIG. 7, an AC-PDP according to a third embodiment of the present invention is similar to the first embodiment except for the configuration of the white dielectric film 10, wherein the first layer 10*a* having a higher dielectric constant than the second layer 10*b* is subjected to patterning by selective etching at a portion between the common electrode 14 and the data electrode 21. The first layer 10*a* remaining between the scanning electrode 13 and the data electrode 21 in the first area of the display cell is made of a piezoelectric ceramic material such as $BaTiO_3$ having a dielectric constant of about 2000.

The second layer 10*b* of the white dielectric film 10 is formed by spreading a paste by using a roll coater after the selective removal of the first layer 10*a*. The second layer 10*b* is made of a white glass paste wherein a glass paste of $PbO—Ba_2O_3—SiO_2$ or ZnO based material having a low melting point and a lower dielectric constant is mixed with $TiO_2$ at a ratio of 10:1. The thickness of the first layer 10*a* is 5 to 20 $\mu$m and the thickness of the second layer 10*b* is about 5 $\mu$m at the top of the first layer 10*a*. The first layer 10*a* may be formed by a printing technique instead of the selective removal.

Figure 8:
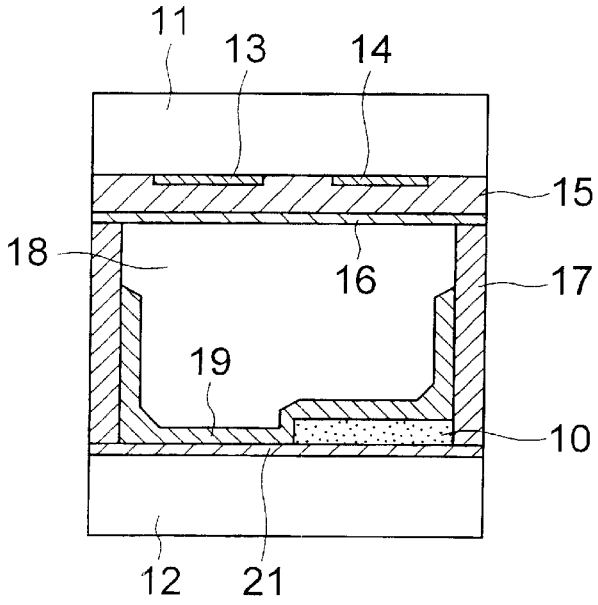
FIG. 8 is a cross-sectional view of a display cell in an AC-PDP according to a fourth embodiment of the present invention.

Referring to FIG. 8, an AC-PDP according to a fourth embodiment of the present invention is similar to the first embodiment except for the configuration of the white dielectric film 10 wherein the white dielectric film 10 includes a single layer, which is selectively removed between the scanning electrode 13 and the data electrode 21 in the first area of the display cell. The thickness of the white dielectric film 10 is between 20 and 80 $\mu$m.

Figure 9:
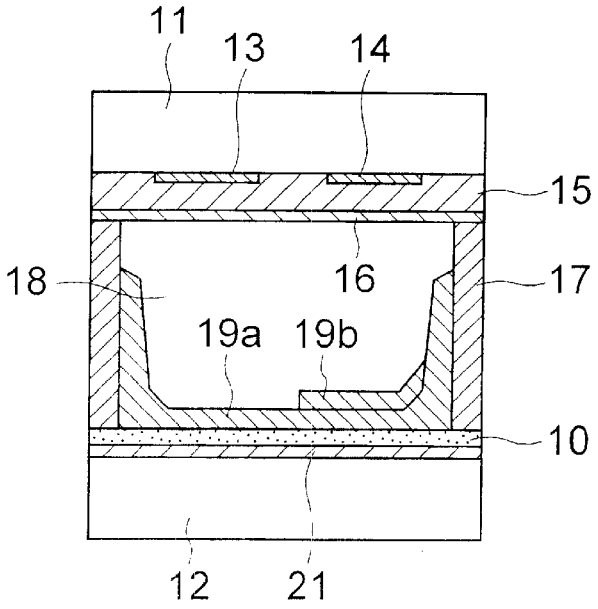
FIG. 9 is a cross-sectional view of a display cell in an AC-PDP according to a fifth embodiment of the present invention.

Referring to FIG. 9, an AC-PDP according to a fifth embodiment of the present invention is similar to the first embodiment except for the configuration of the white dielectric film 10 and the fluorescent film 19. The white dielectric film 10 made of the white glass paste as described above includes a single layer having a uniform thickness of 5 to 40 $\mu$m in the whole cell area and formed by a screen printing technique. The fluorescent film 19 includes a first layer 19*a* formed on the data electrode 21 and the ribs 17 by a screen printing technique to a uniform thickness of 10 to 30 $\mu$m, and a second layer 19*b* formed between the common electrode 14 and the data electrode 21 in the second area of the display cell by a screen printing technique to a thickness of 10 to 15 $\mu$m.

Figure 10:
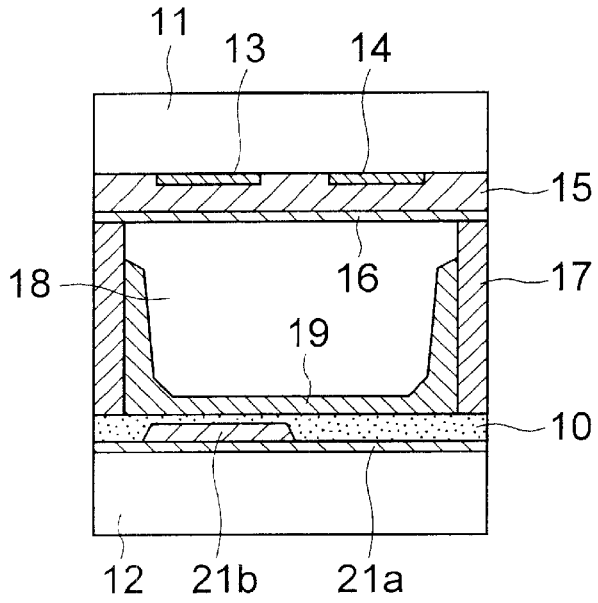
FIG. 10 is a cross-sectional view of a display cell in an AC-PDP according to a sixth embodiment of the present invention.

Referring to FIG. 10, an AC-PDP according to a sixth embodiment of the present invention is similar to the fifth embodiment except for the configuration of the data electrode 21 to achieve different capacitances of the dielectric film instead of achievement by the fluorescent film 19. More specifically, the data electrode 21 includes a uniform thickness portion 21*a* made of Ag and an attachment portion 10*b* attached on the top of a portion of the uniform thickness portion 10*a* opposing the scanning electrode 13 in the first area of the display cell. The attachment portion 21*b* is formed by a printing technique to a thickness of 5 to 10 $\mu$m. The thickness of the white dielectric film is made smaller, or between 5 and 10 $\mu$m, at the top of the attachment portion 21*b* for achievement of a higher capacitance in the first area.

Figure 11:
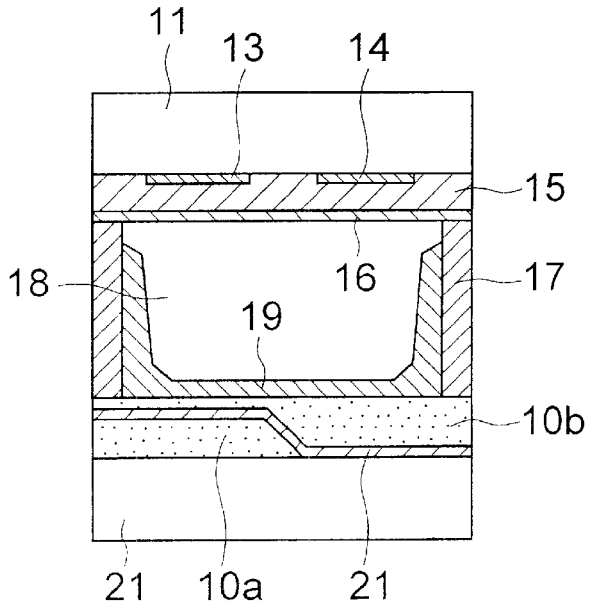
FIG. 11 is a cross-sectional view of a display cell in an AC-PDP according to a seventh second embodiment of the present invention.

Referring to FIG. 11, an AC-PDP according to a seventh embodiment of the present invention is similar to the sixth embodiment except for the configuration of the data electrode 21, wherein the data electrode 21 is raised toward the scanning electrode 13 for a larger capacitance of the insulator film disposed between the scanning electrode 13 and the data electrode 21 in the first area compared to the capacitance of the insulator film disposed between the common electrode 14 and the data electrode 21 in the second area.

In FIG. 11, the first layer 10*a* of the white dielectric film 10 having a thickness of 5 to 20 $\mu$m and made of the white glass paste is subjected to patterning using a photolithographic technique to remove a first portion thereof opposing the common electrode 14 selectively from a second portion opposing the scanning electrode 13. A slope is formed at the boundary between the first portion and the second portion. After the selective etching, the data electrode 21 is formed on the remaining portion of the first layer 10*a* and on the rear substrate 21, followed by spreading the white glass paste thereon to form a second layer 10*b* of the white dielectric film 10 to a thickness of 5 to 20 $\mu$m at the portion thereof opposing the scanning electrode 13.

In the AC-PDPs of the embodiments as described above, the smaller capacitance of the insulator film disposed between the common electrode and the data electrode compared to the capacitance of the insulator film disposed between the scanning electrode and the data electrode provides a larger voltage range of the scanning pulse for a normal operation of the PDPs, whereby malfunction of the PDPs can be suppressed.

Since the above embodiments are described only for examples, the present invention is not limited to the above embodiments and various modifications or alterations can be easily made therefrom by those skilled in the art without departing from the scope of the present invention.

What is claimed is:

1. A plasma display panel (PDP), comprising:

a first substrate and a second substrate opposed to each other;

a plurality of scanning electrodes and a plurality of common electrodes extending parallel to one another and formed on said first substrate;

a first insulator film covering said plurality of scanning electrodes and said plurality of common electrodes;

a plurality of data electrodes extending parallel to one another, being substantially perpendicular to said plurality of scanning electrodes and said plurality of common electrodes, and formed on said second substrate;

a second insulator film covering said plurality of data electrodes; and a plurality of display cells disposed between said first substrate and said second substrate, each of said plurality of display cells, including:

a first cell portion where a data electrode opposes a scanning electrode and between said data electrode and said scanning electrode exists a first capacitance; and a second cell portion where another data electrode opposes a common electrode and between said another data electrode and said common electrode exists a second capacitance, wherein said plurality of data electrodes are formed on a planar surface of said second substrate and said first capacitance of said first cell portion is larger than said second capacitance of said second cell portion.

2. The PDP as defined in claim 1, wherein said second insulator film includes a dielectric film and a fluorescent film consecutively formed on said plurality of data electrodes in at least one of said first and second cell portions.

3. The PDP as defined in claim 2, wherein said dielectric film comprises a larger thickness in said second cell portion than in said first cell portion.

4. The PDP as defined in claim 3, wherein said dielectric film comprises a first layer in said first cell portion, and said first layer and a second layer in said second cell portion.

5. The PDP as defined in claim 2, wherein said dielectric film is not provided in said first cell portion.

6. The PDP as defined in claim 2, wherein said dielectric film has a higher dielectric constant in said first cell portion than in said second cell portion.

7. The PDP as defined in claim 2, wherein said fluorescent film has a smaller thickness in said first cell portion than in said second cell portion.

8. The PDP as defined in claim 2, wherein a thickness of a layer of said plurality of data electrodes in said first cell portion is larger than a thickness of a layer of said plurality of data electrodes in said second cell portion, such that a distance between said scanning electrode and a top surface of said plurality of data electrodes in said first cell portion is smaller than a distance between said common electrode and a top surface of said data electrodes in said second cell portion.

9. The PDP as defined in claim 2, wherein a first portion of said plurality of data electrodes comprises each said data electrode of each said second cell portion formed on said planar surface of said second substrate and a second portion of said plurality of data electrodes comprises each said data electrode of each said first cell portion formed on a layer of said second insulator film formed on said second substrate, such that a distance between said scanning electrode and said data electrode in said first cell portion is smaller than a distance between said common electrode and said data electrode in said second cell portion.

10. A plasma display panel (PDP), comprising:

a first and a second substrate opposed to each other;

a plurality of scanning electrodes and a plurality of common electrodes extending in parallel to one another on said first substrate;

a first insulator film covering said plurality of scanning electrodes and said plurality of common electrodes;

a plurality of data electrodes extending in parallel to one another and substantially perpendicular to said plurality of scanning electrodes and said plurality of common electrodes;

a second insulator film covering said plurality of data electrodes; and a plurality of display cells disposed between said first substrate and said second substrate, each of said plurality of display cells, including:

a first cell portion where a data electrode of said plurality of data electrodes opposes a scanning electrode and between said data electrode and said scanning electrode exists a first capacitance; and a second cell portion where another data electrode of said plurality of data electrodes opposes a common electrode and between said another data electrode and said common electrode exists a second capacitance, wherein said plurality of data electrodes are formed on a planar surface of said second substrate and at least one of said first insulator film and said second insulator film has a first capacitance per unit area in said first cell portion and a second capacitance per unit area in said second cell portion, an area of at least one of said first insulator film and said second insulator film of said second cell portion does not substantially exceed a corresponding area of said first cell portion, and said second capacitance per unit area is smaller than said first capacitance per unit area.

11. The PDP as defined in claim 10, wherein said second insulator film includes a dielectric film and a fluorescent film consecutively formed on said plurality of data electrodes in at least one of said first and second cell portions.

12. The PDP as defined in claim 11, wherein said dielectric film comprises a larger thickness in said second cell portion than in said first cell portion.

13. The PDP as defined in claim 12, wherein said dielectric film comprises a first layer in said first cell portion, and said first layer and a second layer in said second cell portion.

* * * * *